United States Patent [19]

Hooker

[11] 4,184,683

[45] Jan. 22, 1980

[54] SLOT MACHINE APPARATUS

[75] Inventor: Donald E. Hooker, Wilmette, Ill.

[73] Assignee: Bally Manufacturing Corp., Chicago, Ill.

[21] Appl. No.: 908,081

[22] Filed: May 22, 1978

[51] Int. Cl.[2] ..... A63F 5/04

[52] U.S. Cl. ..... 273/143 R

[58] Field of Search ..... 273/143 R, 143 A, 143 B, 273/143 C, 143 D, 143 E, 138 A, 141 A

[56] References Cited

U.S. PATENT DOCUMENTS

| | | | |
|---|---|---|---|
| 2,527,661 | 10/1950 | Stack | 273/143 R |
| 2,579,241 | 12/1951 | Nicolaus | 273/138 A X |
| 3,034,790 | 5/1962 | Breitenstein | 273/138 A X |
| 3,733,075 | 5/1973 | Hooker et al. | 273/143 R X |
| 4,037,845 | 7/1977 | Hooker | 273/143 R |
| 4,097,048 | 6/1978 | Poulsen et al. | 273/143 R |

FOREIGN PATENT DOCUMENTS

| | | | |
|---|---|---|---|
| 1178302 | 1/1970 | United Kingdom | 273/138 A |
| 1242298 | 8/1971 | United Kingdom | 273/143 R |
| 1292712 | 10/1972 | United Kingdom | 273/143 R |

*Primary Examiner*—Richard C. Pinkham
*Assistant Examiner*—Arnold W. Kramer
*Attorney, Agent, or Firm*—Fitch, Even & Tabin

[57] ABSTRACT

An amusement apparatus including a plurality of coaxially mounted rotatable drums, each bearing on its periphery a variety of symbols. A motor is provided for rotating the drums during a playing cycle and solenoid operated panels are provided for arresting rotation of the drums whereby each drum displays a symbol in a viewing area. An electrical circuit is provided, which in advance of the playing cycle, permits the player to select a specific symbol at which a drum will stop. Also, an electrical circuit may be provided to prevent rotation of a drum during the next playing cycle thereby holding the drum at a selected symbol.

5 Claims, 5 Drawing Figures

SLOT MACHINE APPARATUS

The present invention relates to an amusement apparatus of the type known as a slot machine.

Amusement apparatus of the slot machine type normally comprises three co-axially mounted rotatable drums, each bearing on its periphery a variety of symbols. The drums are caused to be rotated when a player actuates a lever or depresses a starting button and, at the end of a normal play cycle, the drums are randomly arrested by suitable electrical or mechanical means, with each drum displaying a symbol in the viewing area. Together these symbols form combinations in a horizontal row with certain ones being considered winning combinations, entitling the player to a reward or prize while certain other combinations are considered losing combinations. Conventionally, in such amusement apparatus, the drums when arrested and regardless of the combination displayed would remain in such condition until again caused to be actuated in the next succeeding play cycle.

The amusement value of such apparatus is greatly enhanced if the player can control, to a certain degree, the action of the drums, e.g. inhibiting selected drums from rotating during the next playing cycle and/or selecting the symbol at which a drum will stop during the next playing cycle.

An object of the present invention is to provide an amusement device in which the player is provided in advance of the next play cycle with the means for preventing the rotation of certain drums and/or means for specifying the stopping point for certain drums. Other objects and advantages of the invention will become apparent by reference to the following description and accompanying drawings wherein.

Figure 1:
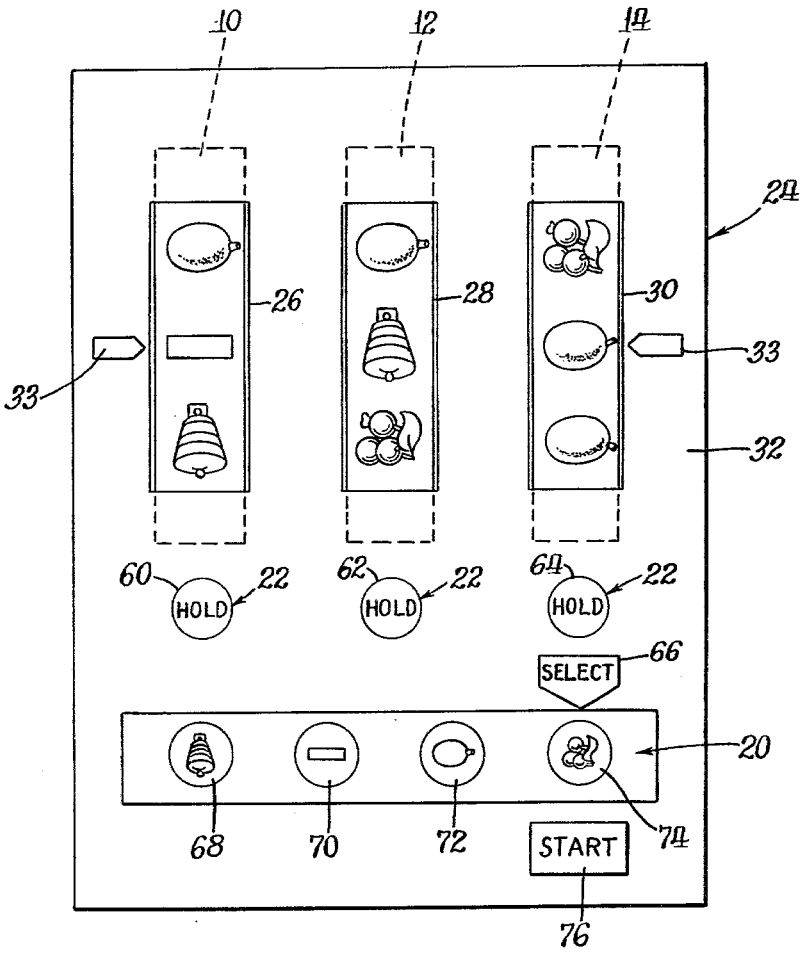
FIG. 1 is a front elevational view of an amusement apparatus embodying my invention.

Generally, as shown in the drawings, an amusement apparatus is provided which includes a plurality of co-axially mounted rotatable drums 10, 12 and 14, each bearing on its periphery a variety of symbols. Means 16 are provided for rotating the drums 10, 12 and 14 during a playing cycle and means 18 are provided for arresting rotation of the drums whereby each drum displays a symbol in a viewing area. Additional means 20 are provided which, in advance of the playing cycle, permits the player to select a specific symbol at which a drum will stop. Also, means 22 may be provided to prevent rotation of a drum during the next playing cycle thereby holding the drum at a selected symbol.

More particularly, as shown in FIG. 1, the amusement apparatus includes a console type cabinet 24 provided with three elongated rectangular viewing areas 26, 28 and 30 on an upper portion of a front panel 32 of the cabinet. The cabinet houses a mechanism which includes the three drums 10, 12 and 14 co-axially mounted in side by side relationship. Each drum includes a peripheral viewing surface on which are displayed a plurality of symbols. The drums 10, 12 and 14 are disposed in registration with respective viewing areas 26, 28 and 30 and, as illustrated in FIG. 1, three vertically aligned symbols are visible in each viewing area. Three symbols, one on each drum, are arranged in horizontal registration with reference indicators 33 on the front panel of the cabinet 24.

Figure 3:
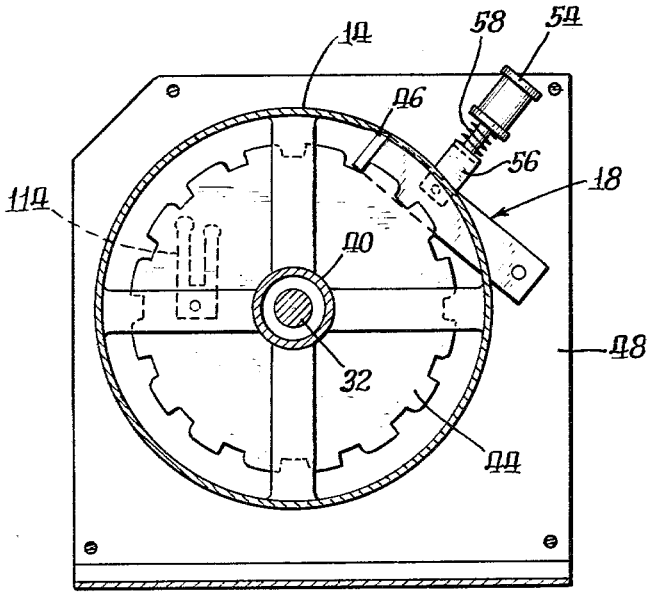
FIG. 3 is a cross sectional view taken generally along line 3—3 of FIG. 2.
Figure 2:
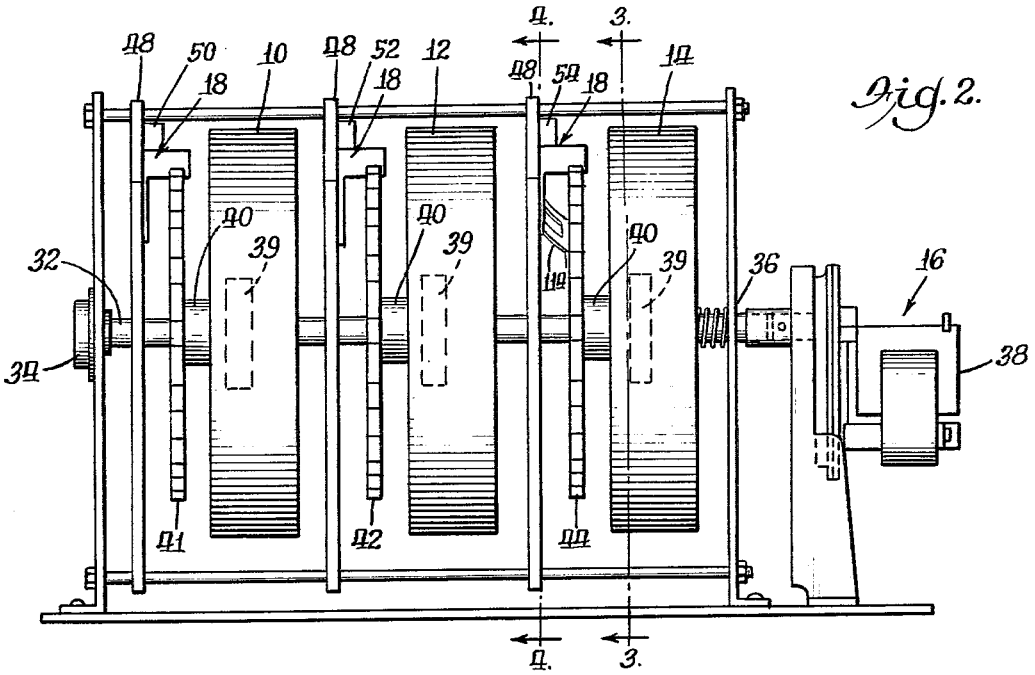
FIG. 2 is a fragmentary front elevational view of the drums and associated drive mechanism within the apparatus shown in FIG. 1.

As shown in FIG. 2, the drums 10, 12 and 14 are rotatably mounted on a shaft 32 journalled in suitable bearings 34 and 36 and operatively connected at one end to an electric motor 38. Each drum includes a clutch mechanism 39 to effect driving engagement between a hub 40 of the drum and the shaft 32. Fixed to the hubs 40 of the drums 10, 12 and 14 are ratchet wheels 41, 42 and 44, respectively. The number of ratchet teeth formed on each of the ratchet wheels corresponds to the number of symbols carried on the peripheral viewing area of a drum. Associated with each ratchet wheel is the arresting means 18 which, as illustrated in FIG. 3, includes a pawl 46 pivotally mounted at its lower end on a vertical plate 48. Three solenoids 50, 52 and 54, one for each pawl 46, are mounted on respective plates 48 and each has its armature connected to the associated pawl through a link 56. Each pawl 46 is biased by a spring 58 in the direction of the respective ratchet wheel. At the beginning of the play cycle, each solenoid 50, 52 and 54 is energized to maintain the respective pawls out of engagement with the teeth of the ratchet wheels 41, 42 and 44. When solenoid 50, 52 or 54 is de-energized the spring 58 causes the associated pawl 46 to rock in a counterclockwise direction as viewed in FIG. 3 to engage the associated ratchet wheel 41, 42 or 44 and arrest movement of the associated drum 10, 12 or 14.

Beneath the drums 10, 12 and 14 are located push button switches 60, 62 and 64, respectively. The function of each switch 60–64 is to prevent the drum directly above it from rotating during the next playing cycle. Directly below button 64 a sign 66 saying SELECT is located. This sign points to a panel containing four push button switches 68, 70, 72 and 74 on the surface of which are displayed four different symbols. Below this panel a start button 76 is located.

Figure 5:
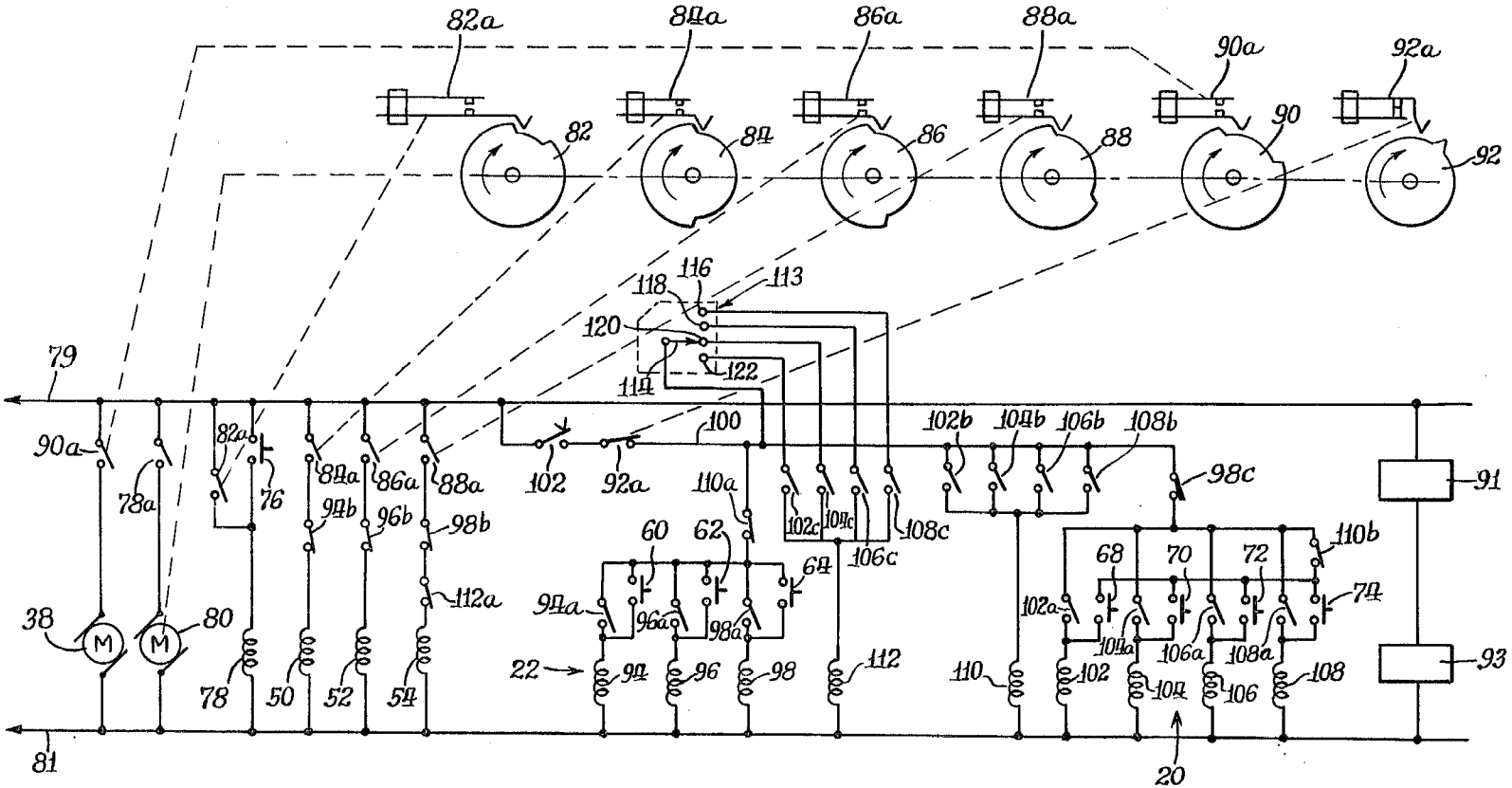
FIG. 5 is a schematic diagram of the electrical circuit of the apparatus shown in FIG. 1.

The operation of the game apparatus will be best described by referring to the schematic diagram of the electrical circuit illustrated in FIG. 5. Lines 79 and 81 are the power supply lines for the circuit. A playing cycle is initiated by pressing the start button 76, which energizes a start relay 78, thereby closing its normally open contact 78*a* turning on a control unit motor 80. The control unit motor rotates six cams 82, 84, 86, 88, 90 and 92 which have different configurations and each is intended to perform a different function. As the control unit motor 80 starts to rotate normally open contact 82*a* is immediately closed by the cam 82 which keeps the start relay 78 energized until the cam 82 has made substantially a complete revolution, (the end of playing cycle) at which time, contact 82*a* opens, dropping out start relay 78, and stopping the control unit motor 80. The drum motor 38 is energized by a normally open contact 90*a*, which is operated by the fifth cam 90. The drum motor 38 continues to rotate until the contact 90*a* opens just before the end of the playing cycle.

At the beginning of a playing cycle, the second cam 84 closes its normally open contact 84*a* which effects energization of solenoid 50 to withdraw pawl 46 from its associated ratchet wheel 41 permitting drum 10 to rotate. The second cam 84 is designed to maintain contact 84*a* closed for substantially ¾ths of a revolution of the cam. Thus, the first drum 10 will continue to rotate for a time interval corresponding to ¾ths of the playing cycle. At such point, the second cam 84 causes the contact 84*a* to open thereby effecting de-energization of the solenoid 50 so that pawl 46 is effective to arrest rotation of the first drum 10.

Similarly, the third cam 86 is designed to maintain its normally open contact 86*a* closed for ½ of a revolution of the cam. While so closed the second drum 12 rotates for an interval corresponding to ½ of the playing cycle. When contact 86*a* is opened, solenoid 52 is de-energized and pawl 46 is effective to arrest rotation of the second drum 12. The fourth cam 88 is designed to maintain its normally open contact 88*a* closed for ⅝ths of a revolution. Thus, the third drum 14 rotates for an interval corresponding to ⅝th of the playing cycle, after which rotation of the third drum is arrested. At this point in the playing cycle, three symbols will be arranged in horizontal registration with the reference indicators 33 on the cabinet 24. Suitable means 91, well-known in the art, may be employed to detect a winning combination of symbols and to close an electrical circuit to a prize dispensing means 93, also well known in the art, if the awarding of prizes is desired.

As previously stated, means 22 are provided to permit the player to hold the display on any selected drum during the next playing cycle. This holding means 22 includes three hold relays 94, 96 and 98 which are energized by the hold switches 60, 62 and 64 respectively. The hold relays are connected to a control power line 100 which is connected to the power line 79 through a normally closed contact 92*a* and a manually operated on-off switch 102. The normally closed contact 92*a* is momentarily opened by the sixth cam 92 at the end of the playing cycle to deenergize whichever hold relay 94, 96 or 98 which may have been energized. The hold relays are maintained energized during the playing cycle by their respective normally open contacts 94*a*, 96*a* and 98*a* which serve as latch contacts. When the first hold 94 is energized, its normally closed switch 94*b* is opened, and the circuit to the first solenoid 50 is opened. The first drum 10 will consequently be held, that is, it will not rotate during the playing cycle, because the first solenoid 50 will not withdraw pawl 46 from ratchet wheel 41. The second hold relay 96 by means of its normally closed contact 96*b* and the third hold relay 98 by means of its normally closed contact 98*b* will, in the same way, hold the second and third drums 12 and 14, respectively, from rotating.

In the illustrated embodiment only the third drum 14 is provided with the means 20 for selecting the specific symbol at which the drum will stop during the next playing cycle. The selection means 20 includes a selection relay for each symbol, that is, a bell relay 102, a bar relay 104, an orange relay 106 and a plum relay 108. The selection relays 102–108 are energized by the selection push button switches 68–74, respectively, and are maintained energized by normally open latch contacts 102*a*, 104*a*, 106*a* and 108*a*. The selection relays 102–108 are prevented from becoming energized if the third hold relay 98 for the third drum has already been energized by the third hold relays normally closed contact 98*c* connected in series with the selection relays. On the other hand, if one of the selection relays has been previously energized, a normally closed contact 110*a* in series with the hold relays 94–98 prevents any hold relay from becoming energized. The contact 110*a* is opened when relay 110 is energized by the closing of normally open contacts 102*b*, 104*b*, 106*b* and 108*b* of selection relays 102, 104, 106 and 108, respectively. The energization of relay 110 also prevents more than one selection to be made by opening its normally closed contact 110*b* connected in series with the selection relays.

Figure 4:
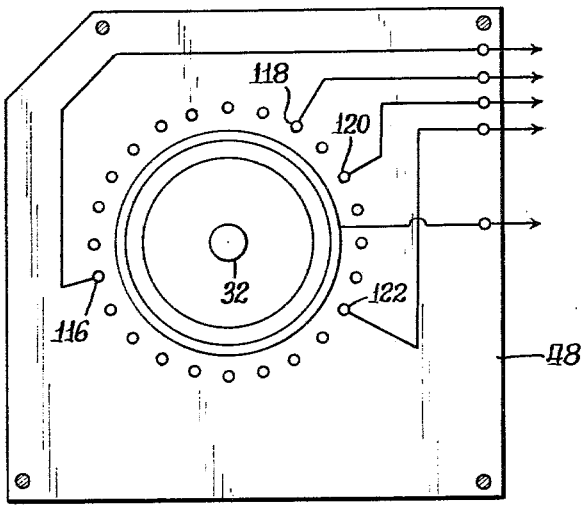
FIG. 4 is a cross sectional view taken generally along line 4—4 of FIG. 2.

The third drum 14 is stopped at the selected symbol by deenergizing the third solenoid 54 just prior to when the selected symbol is displayed. The third solenoid 54 is deenergized by opening a normally closed contact 112*a* in series therewith. The contact 112*a* is opened when its relay 112 is energized by a rotarv switch 113 completing a circuit thereto just prior to tne display of the selected symbol. The rotary switch 113 includes a two finger wiper 114 which, as shown in FIG. 3, is attached to the third ratchet wheel 44. The wiper 114 is thus rotated with the drum 14 and passes over contacts 116, 118, 120 and 122 which, as shown in FIG. 4, are located on the vertical plate 48 opposite the wiper. These contacts are located so that wiper 114 touches contact 116 just before the bell symbol appears on the drum 14, touches contact 118 just before the bar symbol appears, touches contact 120 just before the orange symbol appears and touches contact 122 just before the plum symbol appears. The wiper 114 reaches the selected contact sufficiently in advance of the appearance of the selected symbol to allow for the time required for the stop solenoid 54 to operate, and for pawl 46 to engage ratchet wheel 44. The specific contact of the rotary switch 113 that completes the circuit to the relay 112 is selected by the closing of one of the normally open contacts 102*c*, 104*c*, 106*c* and 108*c* of the respective selection relays 102, 104, 106 and 108.

Various changes and modifications may be made in the above described amusement apparatus without deviating from the spirit or scope of the present invention. Various features of the invention are set forth in the following claims.

What is claimed is:

1. In an amusement apparatus having a plurality of rotating drums, each bearing a plurality of types of symbols and including means for rotating said drums and means for arresting said drums to display various combinations of types of symbols, first means associated with said arresting means of one of said drums for permitting a player to choose, in advance of the drum rotation, any one of the types of symbols to be displayed when the drum stops.

2. The invention in accordance with claim 1 wherein a second means is provided for permitting a player to keep, in advance of actuation of said rotating means, a specific type of symbol displayed on the drum.

3. The invention in accordance with claim 2 wherein the first means includes a rotary switch which is operated by said drum to complete a circuit when a selected type of symbol is displayed on the drum, and means connected to said arresting means for stopping rotation of the drum when the circuit is completed.

4. The invention in accordance with claim 1 wherein the first means includes a rotary switch which is operated by said drum to complete a circuit when a selected type of symbol is displayed on the drum, and means connected to said arresting means for stopping rotation of the drum when the circuit is completed.

5. The invention in accordance with claim 4 wherein the rotary switch includes a wiper coupled to said one drum so as to be rotated therewith, a plurality of contacts one for each type of symbol which can be selected, each of said contacts being positioned so as to be touched by the wiper when the type of symbol represented by that contact is in position to be displayed, and selective means associated with each type of symbol for rendering said contact associated with that type of symbol operative to complete the circuit when touched by said wiper.

* * * * *

UNITED STATES PATENT AND TRADEMARK OFFICE

CERTIFICATE OF CORRECTION

PATENT NO. : 4,184,683

DATED : January 22, 1980

INVENTOR(S) : Donald E. Hooker

It is certified that error appears in the above-identified patent and that said Letters Patent are hereby corrected as shown below:

Column 3, line 1, "3/4ths" should be --3/8ths--.

Column 3, line 3, "3/4ths" should be --3/8ths--.

Signed and Sealed this

*Twenty-sixth* Day of *August 1980*

[SEAL]

*Attest:*

SIDNEY A. DIAMOND

*Attesting Officer*

*Commissioner of Patents and Trademarks*